US007159549B2

(12) United States Patent
Tsukada et al.

(10) Patent No.: US 7,159,549 B2
(45) Date of Patent: Jan. 9, 2007

(54) VARIABLE VALVE SYSTEM OF INTERNAL COMBUSTION ENGINE

(75) Inventors: Tomoya Tsukada, Kanagawa (JP); Kotaro Watanabe, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 21 days.

(21) Appl. No.: 11/154,822

(22) Filed: Jun. 17, 2005

(65) Prior Publication Data

US 2005/0279306 A1 Dec. 22, 2005

(30) Foreign Application Priority Data

Jun. 18, 2004 (JP) ..... 2004-180426

(51) Int. Cl.
*F01L 1/34* (2006.01)

(52) U.S. Cl. ..... 123/90.17; 123/90.15; 123/90.31; 29/888.1; 92/120; 92/121; 92/122; 92/128; 464/1; 464/2; 464/160

(58) Field of Classification Search ..... 123/90.17
See application file for complete search history.

(56) References Cited

U.S. PATENT DOCUMENTS 6,510,827 B1 * 1/2003 Schreeck et al. ..... 123/90.17

FOREIGN PATENT DOCUMENTS

JP 10-008988 A 1/1998

* cited by examiner

*Primary Examiner*—Thomas Denion
*Assistant Examiner*—Kyle M. Riddle
(74) *Attorney, Agent, or Firm*—Foley & Lardner LLP

(57) ABSTRACT

A camshaft is formed at a generally middle portion with an enlarged cylindrical portion. An annular vane member is mounted on the enlarged cylindrical portion and secured thereto by means of a nut. An annular housing or sprocket is arranged to receive therein the annular vane member in a manner to permit a rotation of the vane member relative to the annular housing. Each of a circular opening of the vane member and a circular opening of the annular housing is so sized as to permit cam lobes of the camshaft to pass therethrough.

26 Claims, 10 Drawing Sheets

VARIABLE VALVE SYSTEM OF INTERNAL COMBUSTION ENGINE

BACKGROUND OF THE INVENTION

1. Field of the Invention

The present invention relates in general to a variable valve system of an internal combustion engine, which is able to vary an open/close timing of engine valves (viz., intake and/or exhaust valves) in accordance with an operation condition of the engine. More specifically, the present invention relates to an improvement in reducing the size of such variable valve system.

2. Description of the Related Art

Hitherto, in the field of variable valve systems of an internal combustion engine, various types have been proposed and put into practical use. One of the systems is shown in Japanese Laid-open Patent Application (Tokkaihei) 10-8988.

The variable valve system of the published application is a device for controlling a valve timing of intake and exhaust valves in accordance with an operation condition of an associated internal combustion engine. The device comprises an intake camshaft for intake valves and an exhaust camshaft for exhaust valves.

The exhaust camshaft is provided at one end thereof with a primary sprocket around which a timing chain from a crankshaft is operatively put.

The exhaust camshaft is further provided near the primary sprocket with a secondary sprocket around which a transmission chain from a cam sprocket on the intake camshaft is operatively put.

The intake camshaft is provided at one end thereof with a valve timing control mechanism that varies a relative angular positioning between the cam sprocket and the intake camshaft with the aid of a hydraulic pressure that is fed to an oil housing body through a pressure control valve.

The oil housing body is located nearer to the exhaust camshaft than the primary sprocket of the exhaust camshaft.

SUMMARY OF THE INVENTION

Because of the arrangement of the parts as mentioned hereinabove, the internal combustion engine to which the variable valve system of the published application is practically applied is compelled to have a bulky construction, particularly, an increased length in construction. As is known, bulky construction of the engine makes a layout thereof in an engine room difficult.

It is therefore an object of the present invention to provide a variable valve system of an internal combustion engine, which is compact in size. Thus, an engine to which the variable valve system of the invention is practically applied can be compact in size and thus the layout of the engine in an engine room is readily made.

In accordance with a first aspect of the present invention, there is provided a variable valve system of an internal combustion engine, which comprises a camshaft; a plurality of cam lobes integral with and mounted on the camshaft and operating to open and close engine valves when the camshaft rotates, every adjacent two cam lobes being apart from one another by predetermined distances respectively; an annular vane member having a plurality of vanes that project radially outward therefrom and a circular opening that is sized to permit the cam lobes to pass therethrough; an annular housing housing therein the vane member in a manner to permit a rotation of the vane member relative to the annular housing, the annular housing having a circular opening that is sized to permit the cam lobes to pass therethrough; a drive power transmission mechanism that transmits a torque of a crankshaft of the engine to the annular housing; at least one pair of retarding and advancing work chambers defined between the annular vane member and the annular housing; and a hydraulic circuit that selectively feeds a hydraulic fluid to one of the retarding and advancing work chambers in accordance with an operation condition of the engine, wherein each of an axial length of the annular housing and an axial length of the vane member is set smaller than the shortest one of the predetermined distances, and wherein the vane member is tightly mounted on a given portion of the camshaft to rotate therewith.

In accordance with a second aspect of the present invention, there is provided a variable valve system of an internal combustion engine, which comprises two cylindrical pieces that constitute a camshaft when coaxially connected; a plurality of cam lobes integral with and mounted on the two cylindrical pieces and operating to open and close engine valves when the cylindrical pieces rotate about their common axis; a circular vane member having a plurality vanes that project radially outward therefrom, the vane member being tightly put between mutually facing ends of the cylindrical pieces to rotate together with the camshaft; an annular housing housing therein the vane member in a manner to permit a rotation of the vane member relative to the annular housing, the annular housing having a circular opening that is sized to permit the mutually facing ends of the cylindrical pieces to pass therethrough; a plurality of connecting bolts through which the two cylindrical pieces and the circular vane member are united to constitute a single construction; a drive power transmission mechanism that transmits a torque of a crankshaft of the engine to the annular housing; at least one pair of retarding and advancing work chambers defined between the circular vane member and the annular housing; and a circular circuit that selectively feeds a hydraulic fluid to one of the retarding and advancing work chambers in accordance with an operation condition of the engine.

In accordance with a third aspect of the present invention, there is provided a variable valve system of an internal combustion engine, which comprises a camshaft; a plurality of cam lobes integral with and mounted on the camshaft and operating to open and close engine valves when the camshaft rotates, every adjacent two cam loves being apart from one another by predetermined distances respectively; a circular vane member integral with the camshaft and having a plurality of vanes that project radially outward therefrom; an annular housing housing therein the vane member in a manner to permit a rotation of the vane member relative to the annular housing, the annular housing having a circular opening that is sized to permit the cam lobes and the vane member to pass therethrough; a drive power transmitting mechanism that transmits a torque of a crankshaft of the engine to the annular housing; at least one pair of retarding and advancing work chambers defined between the vane member and the annular housing; and a hydraulic circuit that selectively feeds a hydraulic fluid to one of the retarding and advancing work chambers in accordance with an operation condition of the engine, wherein an axial length of the annular housing is set smaller than the shortest one of the predetermined distances.

In accordance with a fourth aspect of the present invention, there is provided a variable valve system of an internal combustion engine, which comprises a camshaft; a plurality of cam lobes integral with and mounted on the camshaft and operating to open and close engine valves when the camshaft rotates, every adjacent two cam lobes being apart from one another by predetermined distances respectively; an annular vane member having a plurality of vanes that project radially outward therefrom and a circular opening that is sized to permit the cam lobes to pass therethrough; an annular housing housing therein the vane member in a manner to permit a rotation of the vane member relative to the annular housing, the annular housing having a circular opening that is sized to permit the cam lobes to pass therethrough; a drive power transmission mechanism that transmits a torque of a crankshaft of the engine to the annular housing; at least one pair of retarding and advancing work chambers defined between the annular vane member and the annular housing; and a hydraulic circuit that selectively feeds a hydraulic fluid to one of the retarding and advancing work chambers in accordance with an operation condition of the engine, wherein each of the circular opening of the annular vane member and the circular opening of the annular housing is larger in diameter than an imaginary circle that has a diameter extending between highest and lowest parts of each cam lobe and larger in diameter than an imaginary circle that is drawn by a radially outermost part of each cam lobe when the camshaft rotates, and wherein the vane member is tightly mounted on a given portion of the camshaft to rotate therewith.

In accordance with a fifth aspect of the present invention, there is provided a method of assembling a variable valve system of an internal combustion engine, the variable valve system comprising a camshaft; a plurality of cam lobes integral with and mounted on the camshaft and operating to open and close engine valves when the camshaft rotates, every adjacent two cam lobes being apart from one another by predetermined distances respectively; an annular vane member having a plurality of vanes that project radially outward therefrom and a circular opening that is sized to permit the cam lobes to pass therethrough; an annular housing housing therein the vane member in a manner to permit a rotation of the vane member relative to the annular housing, the annular housing having a circular opening that is sized to permit the cam lobes to pass therethrough; a drive power transmission mechanism that transmits a torque of a crankshaft of the engine to the annular housing; at least one pair of retarding and advancing work chambers defined between the annular vane member and the annular housing; and a hydraulic circuit that selectively feeds a hydraulic fluid to one of the retarding and advancing work chambers in accordance with an operation condition of the engine, each of an axial length of the annular housing and an axial length of the vane member being smaller than the shortest one of the predetermined distances, the method comprising the steps of producing a unit including the annular housing that has the vane member loosely received therein; setting the vane member at a right position in the annular housing; putting the unit onto the camshaft from one end of the camshaft allowing the circular openings thereof to receive therein the camshaft; moving the unit to an enlarged given portion of the camshaft by carrying out a zig-zag movement of the unit to clear the cam lobes; positioning the unit relative to the enlarged given portion; and engaging a nut with a threaded part of the enlarged given portion to press the vane member against a flange portion of the enlarged given portion thereby to secure the vane member to the enlarged given portion.

Other objects and advantages of the present invention will become apparent from the following description when taken in conjunction with the accompanying drawings.

DETAILED DESCRIPTION OF THE EMBODIMENTS

In the following, embodiments of the present invention will be described in detail with reference to the accompanying drawings.

For ease of understanding, various directional terms, such as, right, left, upper, lower and the like are used in the following description. However, such terms are to be understood with respect to only drawing or drawings on which a corresponding part or portion is shown.

As will be understood from the following description, a variable valve system of the present invention is designed for a four cylinder type internal combustion engine having for each cylinder one intake valve and one exhaust valve.

Figure 1:
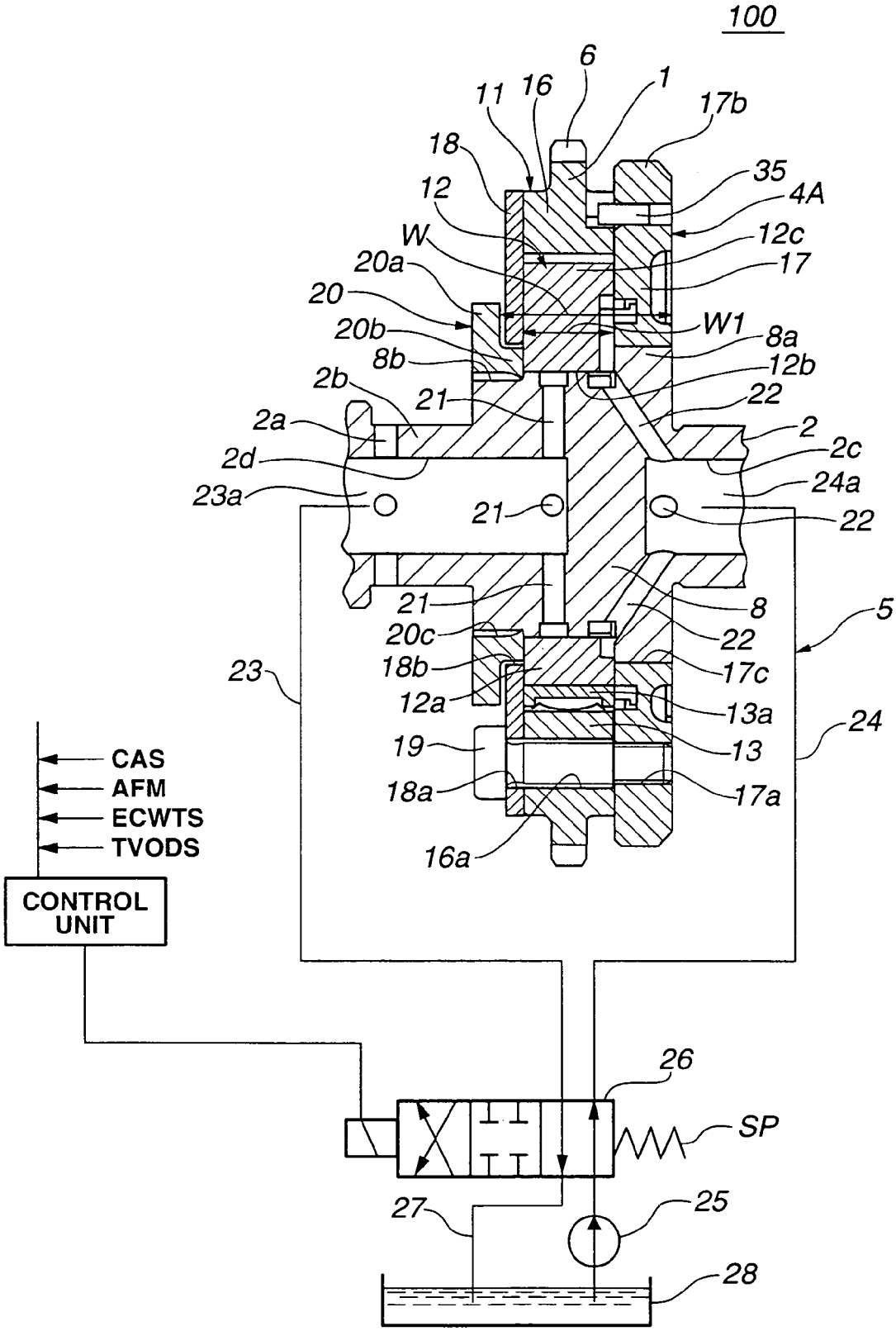
FIG. 1 is a sectional view of a valve timing control mechanism employed in a variable valve system of a first embodiment of the present invention.

Referring to FIGS. 1 to 9, particularly FIG. 1, there is shown a valve timing control mechanism 100 employed in a variable valve system of a first embodiment of the present invention.

Figure 5:
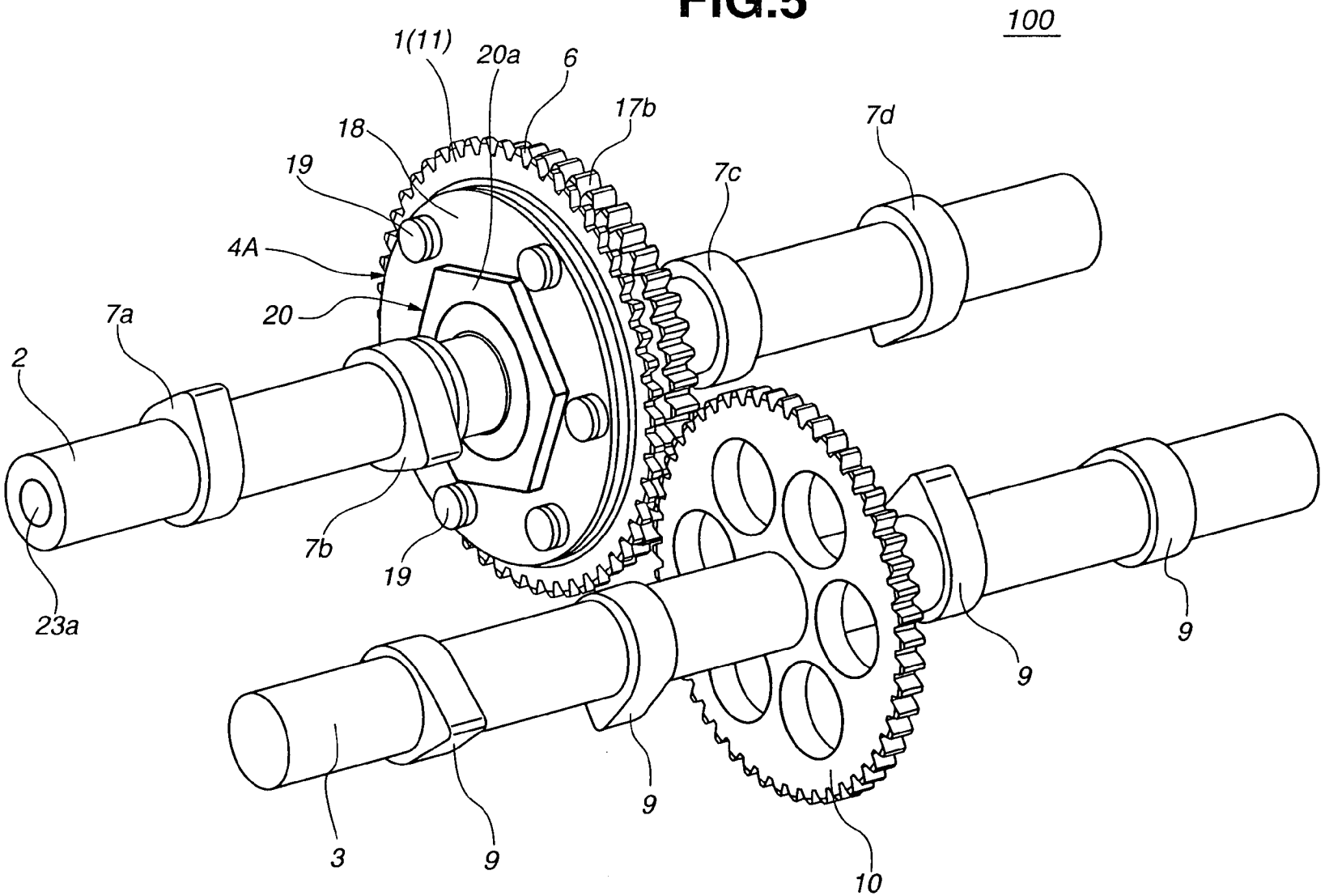
FIG. 5 is a perspective view of the valve timing control mechanism employed in the variable valve system of the first embodiment, which is in association with an exhaust camshaft.
Figure 6:
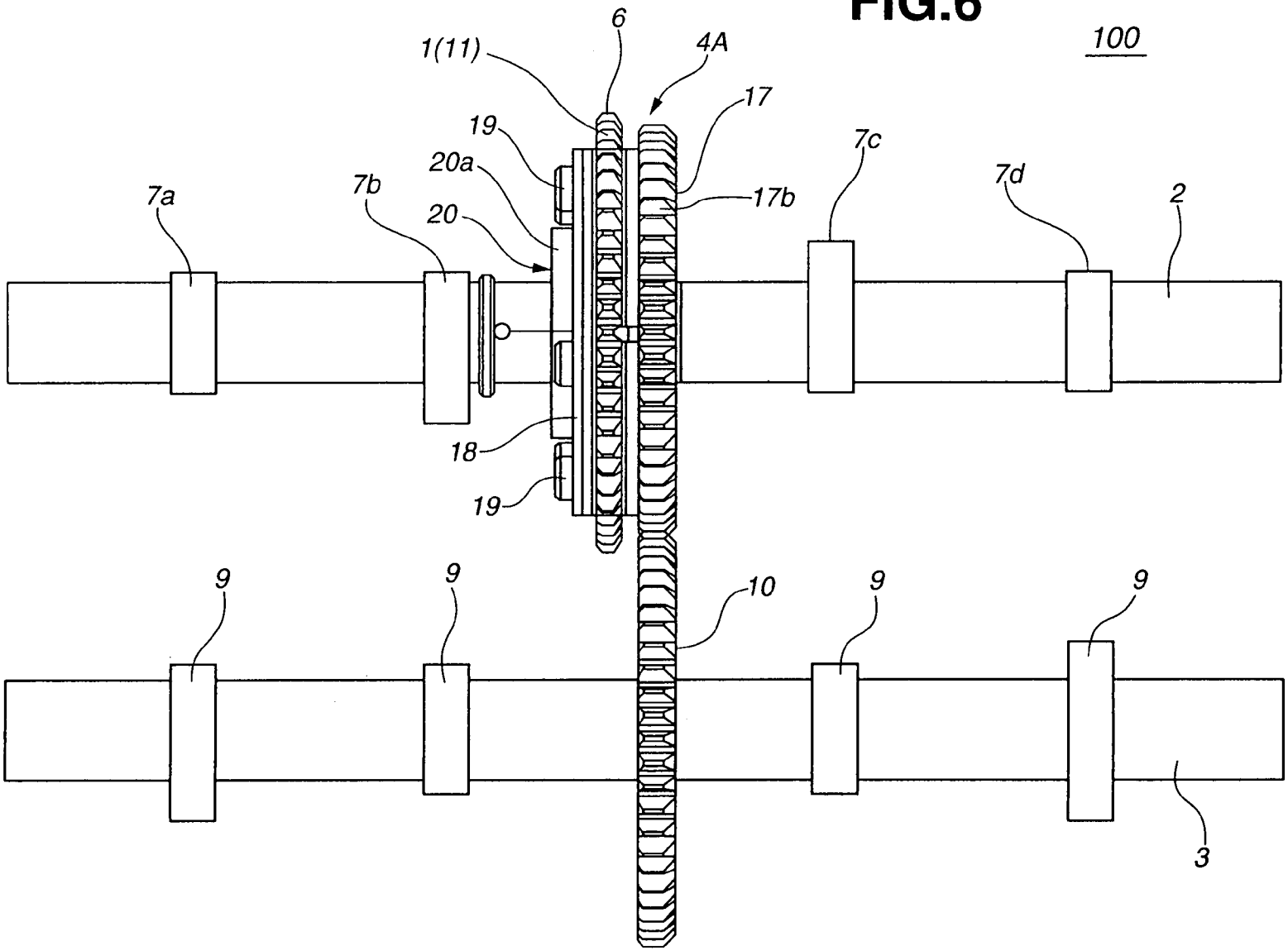
FIG. 6 is a plan view of the valve timing control mechanism and the exhaust camshaft.

As will be understood from FIGS. 1, 5 and 6, valve timing control mechanism 100 to which the present invention is practically applied comprises generally a sprocket 1 that is driven by a crankshaft (not shown) of an associated internal combustion engine through a timing chain (not shown), an intake camshaft 2 that extends along an elongate axis of the engine and passes through sprocket 1 in a manner to achieve a relative rotation therebetween, an exhaust camshaft 3 (see FIG. 5) that extends in parallel with intake camshaft 2, a phase change mechanism 4A that is arranged between sprocket 1 and intake camshaft 2 to change a relative angular positioning therebetween, and a hydraulic circuit 5 (see FIG. 1) that actuates phase change mechanism 4A.

As will be described in detail hereinafter, sprocket 1 is integrally formed with a housing of phase change mechanism 4A, and has a first gear 6 around which the timing chain from a drive sprocket of the crankshaft is operatively put.

Intake camshaft 2 is rotatably supported on a cylinder head (not shown) of the engine through cam bearings (not shown). As is seen from FIGS. 2, 5 and 6, four cam lobes 7*a*, 7*b*, 7*c* and 7*d* are integrally formed on intake camshaft 2 at equally spaced intervals, each cam lobe 7*a*, 7*b*, 7*c* or 7*d* being designed to open and close the corresponding intake valve (not shown).

Figure 2:
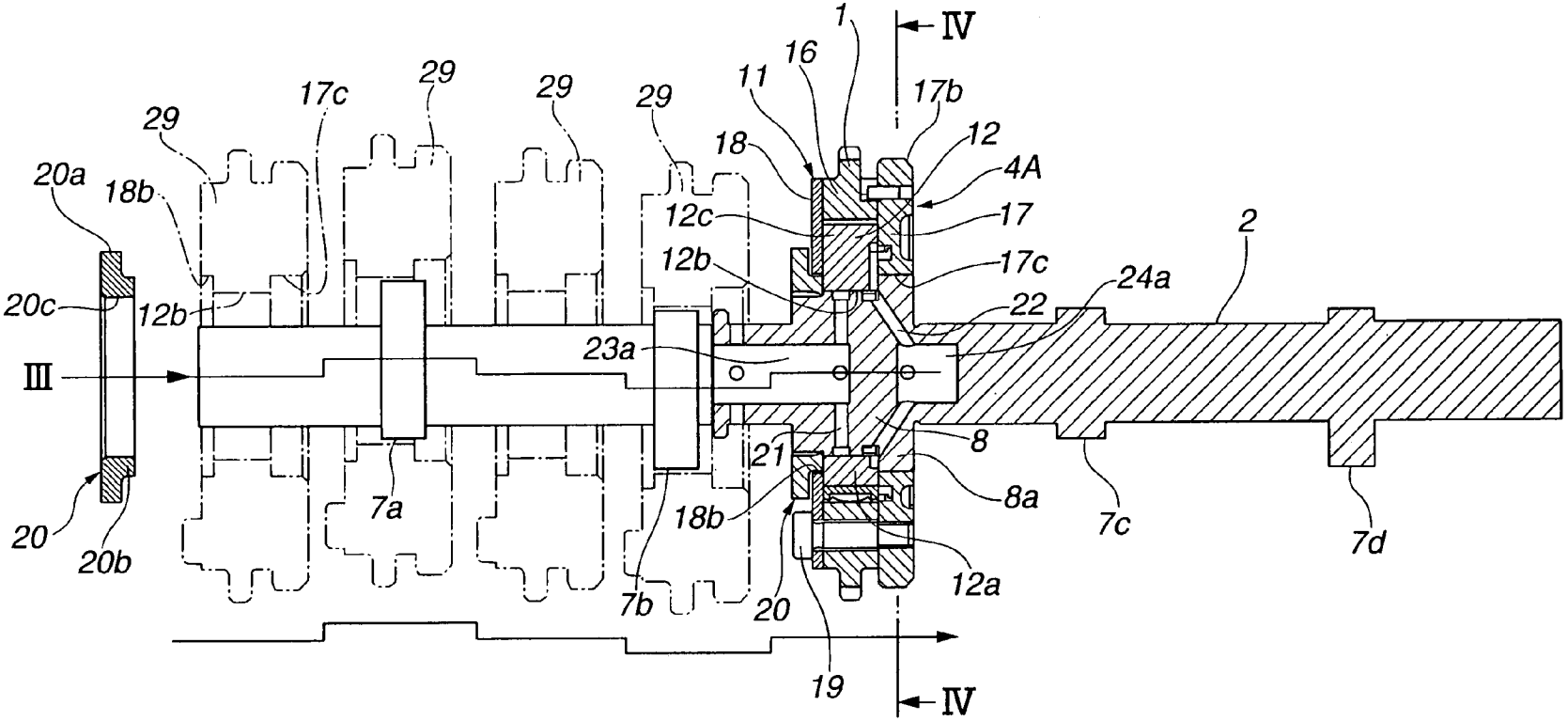
FIG. 2 is a sectional view of the valve timing control mechanism employed in the variable valve system of the first embodiment, showing a method for mounting a given unit onto a given portion of an intake camshaft.

As is seen from FIGS. 1 and 2, intake camshaft 2 has at its generally middle part an enlarged cylindrical portion 8. As is seen from these drawings, enlarged cylindrical portion 8 has at its right part a thicker flange portion 8*a* and at its left part an externally threaded portion 8*b*.

As is seen from FIGS. 5 and 6, four cam lobes 9 are integrally formed on exhaust camshaft 3 at equally spaced intervals like the above-mentioned intake camshaft 2, each cam lobe 9 being designed to open and close the corresponding exhaust valve (not shown). As shown in these drawings, exhaust camshaft 3 has at its generally middle part a transmission gear 10 secured thereto.

As is seen from FIGS. 1, 7 to 9, phase change mechanism 4A comprises an annular housing 11 that is integral with sprocket 1, an annular vane member 12 that is tightly mounted on enlarged cylindrical portion 8 of intake camshaft 2 and is rotatably received in annular housing 11, six vanes 12*c* that are provided by vane member 12, six partition projections 13 that are provided by annular housing 11, six retarding work chambers 14 and six advancing work chambers 15 that are defined by six vanes 12*c* of vane member 12 and six partition projections 13 of annular housing 11. It is to be noted that each retarding work chamber 14 and its partner advancing work chamber 15 are partitioned by one vane 12*c* located therebetween.

As is seen from FIG. 1, annular housing 11 generally comprises an annular housing body 16, a first annular plate 17 arranged on a right side of housing body 16 and a second annular plate 18 arranged on a left side of housing body 16.

Figure 3:
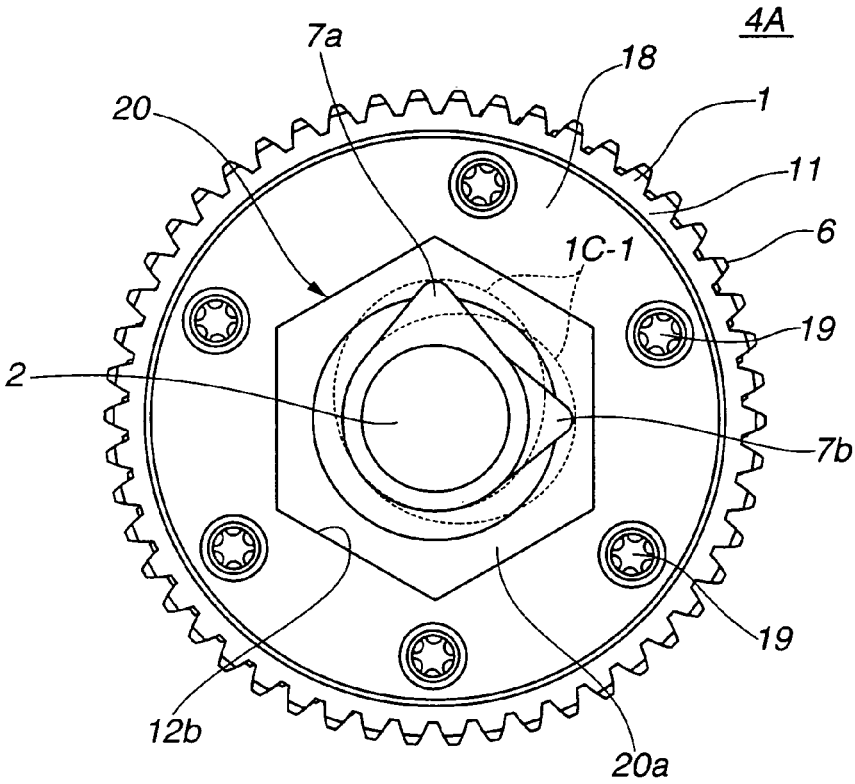
FIG. 3 is an enlarged view taken from the direction of arrow "III" of FIG. 2.
Figure 4:
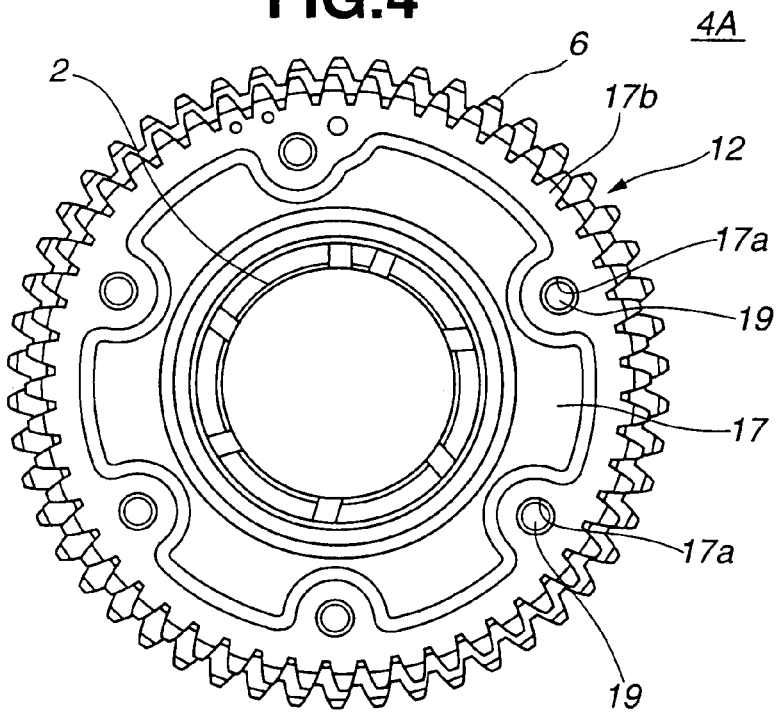
FIG. 4 is an enlarged sectional view taken along the line "IV—IV" of FIG. 2.

As is seen from FIGS. 1 and 3, housing body 16 and first and second annular plates 17 and 18 are tightly united by means of six bolts 19. As is seen from FIG. 1, each bolt 19 is passed through aligned openings, that are an opening 18*a* of second annular plate 18 and an opening 16*a* of housing body 16, and engaged with an internally threaded opening 17*a* of first annular plate 17.

As is seen from FIGS. 1 and 5, first annular plate 17 is integrally formed at a periphery thereof with a second gear 17*b* that is meshed with transmission gear 10 of exhaust camshaft 3.

As is seen from FIG. 1, first annular plate 17 is formed with a circular opening 17*c* of which cylindrical surface is rotatably or slidably put on a cylindrical outer surface of a thicker flange portion 8*a* of intake camshaft 2. As shown, by using a locate pin 35, positioning of first annular plate 17 in radial and circumferential directions relative to housing body 16 is achieved.

As is seen from FIGS. 1 and 5, second annular plate 18 has an outer diameter that is equal to that of housing body 16, and second annular plate 18 has a circular opening 18*b* whose outer diameter is substantially the same as that of the above-mentioned circular opening 17*c* of first annular plate 17. Into circular opening 18*b*, there is rotatably received a cylindrical base portion 20*b* of a nut 20 that will be described in detain hereinafter.

As is seen from FIGS. 1 and 5, an inner diameter of annular housing body 16 is slightly larger than an outer diameter defined by the outermost edges of vanes 12*c* of annular vane member 12, and sufficiently larger than an outermost diameter of cam lobes 7*a*, 7*b*, 7*c* and 7*d*.

It is to be noted that, as is seen from FIG. 3, the outermost diameter of cam lobes 7*a*, 7*b*, 7*c* and 7*d* is the diameter of an imaginary circle "IC-1" that has a diameter extending between highest and lowest parts of each cam lobe 7*a*, 7*b*, 7*c* or 7*d*.

As will be understood from FIGS. 1 and 5, circular opening 17*c* of first annular plate 17 and circular opening 18*b* of second annular plate 18 are so sized as to pass therethrough left cam lobes 7*a* and 7*b* or right cam lobes 7*c* and 7*d* (as viewed in FIG. 5).

Furthermore, as is seen from these drawings, an axial length "W" (see FIG. 1) of annular housing 11 is set smaller than the shortest one of an axial distance between the left cam lobes 7*a* and 7*b* and that between the right cam lobes 7*c* and 7*d*.

Although in the illustrated embodiment only one cam lobe 7*a*, 7*b*, 7*c* or 7*d* is provided for each cylinder, two or three cam lobes with the same cam angle may be provided for each cylinder. In this modification, even if the distance between adjacent cam lobes is smaller than the entire axial length "W" of annular housing 11, the cam lobes can pass through the circular openings 17*c* and 18*b* of housing body 16 because the cam lobes have the same cam angle.

Figure 7:
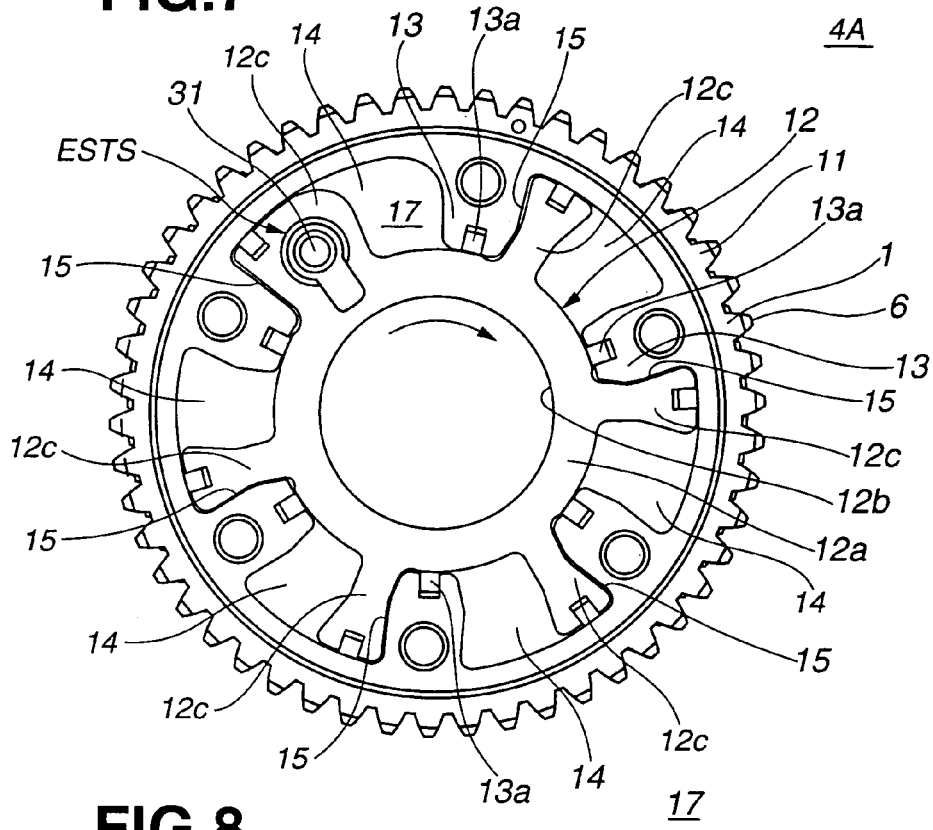
FIG. 7 is a sectional view of the valve timing control mechanism in a condition wherein the valve timing is set in a retarded side.

As is seen from FIGS. 1 and 7, annular vane member 12 is constructed of a metal and comprises a circular vane rotor portion 12*a* that has a circular opening 12*b* tightly disposed on enlarged cylindrical portion 8 of intake camshaft 2, and six vanes 12*c* that are radially outwardly projected from circular vane rotor portion 12*a* at generally equally spaced (viz., about 60 degrees) intervals.

As is seen from FIG. 1, for securing annular vane member 12 to enlarged cylindrical portion 8 of intake camshaft 2, vane member 12 is slidably received on enlarged cylindrical portion 8 from the left end of the portion 8 and moved rightward to a position where circular vane rotor portion 12*a* intimately contacts a left surface of flange portion 8*a* of intake camshaft 2. Then, nut 20 loosely engaged with externally threaded portion 8*b* of intake camshaft 2 is turned in a fastening direction. With this, circular vane rotor portion 12*a* is tightly sandwiched between flange portion 8*a* and nut 20.

As is seen FIG. 7, each partition projection 13 of annular housing 11 is provided at a leading end thereof with a seal member 13*a* that slidably and hermetically contacts an outer periphery of circular vane rotor portion 12*a*. Thus, when intake camshaft 2 rotates, vane member 12 fixed thereto is rotated together in the same direction. The rotation of vane member 12 relative to annular housing 11 is limited in a range between a position where vane 12*c* of vane member 12 contacts with one partition projection 13 of housing 11 and another position where vane 12*c* contact with the partner's partition projection 13. During this, the outer periphery of circular vane rotor portion 12*a* of vane member 12 hermetically and slidably contacts each seal member 13*a*.

As is seen from FIG. 3, the diameter of circular opening 12*b* of vane member 12 is slightly larger than the outermost diameter "IC-1" of cam lobes 7*a*, 7*b*, 7*c* and 7*d*.

As will be understood from FIGS. 1 and 5, an axial length "W1" (see FIG. 1) of vane member 12 is set smaller than the shortest one of the axial direction between the left cam lobes 7*a* and 7*b* and that between the right cam lobes 7*c* and 7*d*.

If two or three cam lobes with the same cam angle are provided for each cylinder as has been mentioned hereinabove, the cam lobes can pass through the circular opening 12*b* of vane member 12 even if the distance between adjacent cam lobes is smaller than the entire axial length "W1" of vane member 12. This is because the cam lobes have the same cam angle.

As is seen from FIGS. 1 and 5, nut 20 comprises a hexagonal head 20*a* and a cylindrical base portion 20*b* coaxially integral with head 20*a*. As shown in FIG. 1, upon proper assemblage, hexagonal head 20*a* is flush with heads of bolts 19.

Nut 20 is formed with an internally threaded portion 20*c* that is meshed with externally threaded portion 8*b* of intake camshaft 2. Thus, for tuning nut 20, a spanner having a hexagonal mouth is usable.

Referring back to FIG. 7, between adjacent two partition projections 13 of annular housing 11, there is positioned one vane 12*c* of vane member 12 thereby to define retarding and advancing work chambers 14 and 15 at the opposite sides of the vane 12*c*.

As is seen from FIG. 1 and from FIG. 7, six retarding work chambers 14 are communicated through six radial passages 21 formed in enlarged cylindrical portion 8. Like this, six advancing work chambers 15 are communicated through six radial passages 22 formed in enlarged cylindrical portion 8.

Hydraulic circuit 5 is constructed to selectively feed or draw a hydraulic pressure to or from retarding and advancing work chambers 14 and 15.

As is seen from FIG. 1, hydraulic circuit 5 comprises a retarding fluid passage 23 that is connected retarding work chambers 14 through six radial passages 21, an advancing fluid passage 24 that is connected to advancing work chambers 15 through six radial passages 22, a trochoid type oil pump 25 that selectively feeds or draws the hydraulic pressure to or from retarding and advancing fluid passages 23 and 24 and an electromagnetic switch valve 26 that switches fluid flow direction of these two passages 23 and 24 in accordance with an operation condition of an associated internal combustion engine.

As shown in FIG. 1, six radial passages 21 have radially inner ends exposed to a cylindrical bore 2*d* formed intake camshaft 2 at a left side of enlarged cylindrical portion 8, and the other radial passages 22 have radially inner ends exposed to another cylindrical bore 2*c* formed in intake camshaft 2 at a right side of enlarged cylindrical portion 8.

As shown in the drawing, retarding and advancing fluid passages 23 and 24 have respective ends connected to electromagnetic switch valve 26 and respective other ends 23*a* and 24*a* exposed to cylindrical bores 2*d* and 2*c* respectively. As shown, intake camshaft 2 is formed at a left part 2*b* of enlarged cylindrical portion 8 with radial openings 2*a* through which part of the hydraulic fluid is led into a bearing (not shown) that bears the left part 2*b*.

As shown, electromagnetic switch valve 26 is of a four port two position type and controlled by the control unit. That is, upon receiving information from the control unit, a spool is axially moved in one or other direction in a valve body thereby to connect an outlet port of the switch valve 26 to either one of retarding and advancing fluid passages 23 and 24 and at the same time to connect a drain passage 27 to the other of the fluid passages 23 and 24. As shown, an inlet passage of oil pump 25 and drain passage 27 are both connected to an oil pan 28.

The control unit has a microcomputer that comprises a central processing unit (CPU), a random access memory (RAM), a read only memory (ROM) and input and output interfaces. Upon receiving information signals from a crank angle sensor "CAS", an air flow meter "AFM", an engine cooling water temperature sensor "ECWTS", a throttle valve open degree sensor "TVODS", etc., the control unit detects an operation condition of the engine and feeds electromagnetic switch valve 26 with an instruction signal (viz., pulse signal) in accordance with the detected operation condition of the engine.

Figure 8:
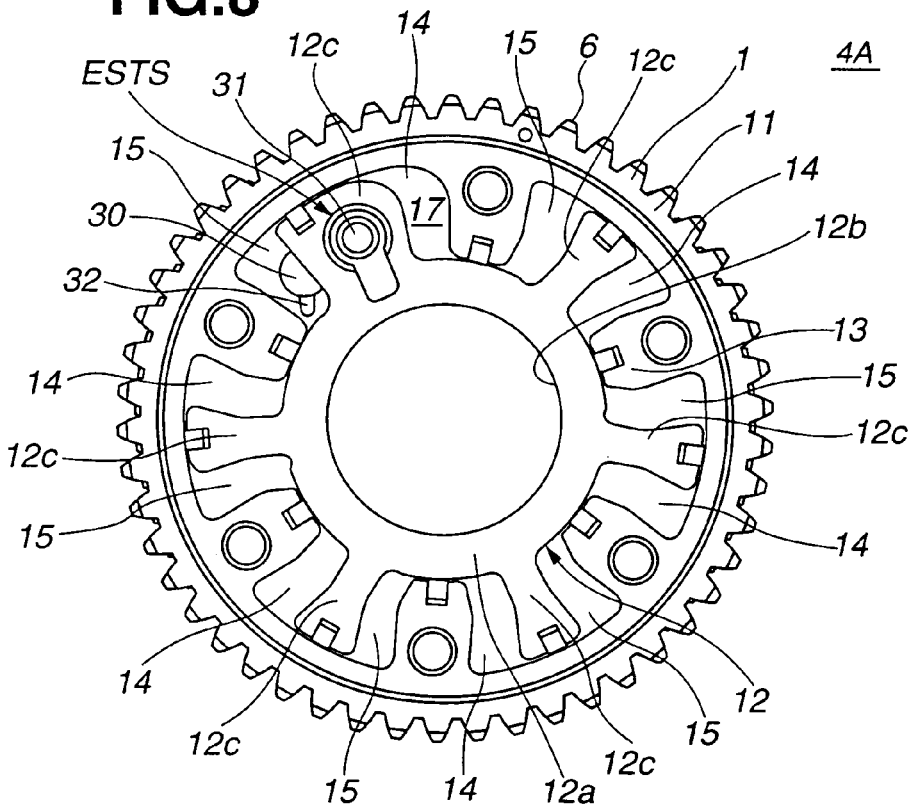
FIG. 8 is a view similar to FIG. 7, but showing a condition wherein the valve timing is set in an intermediate side.
Figure 9:
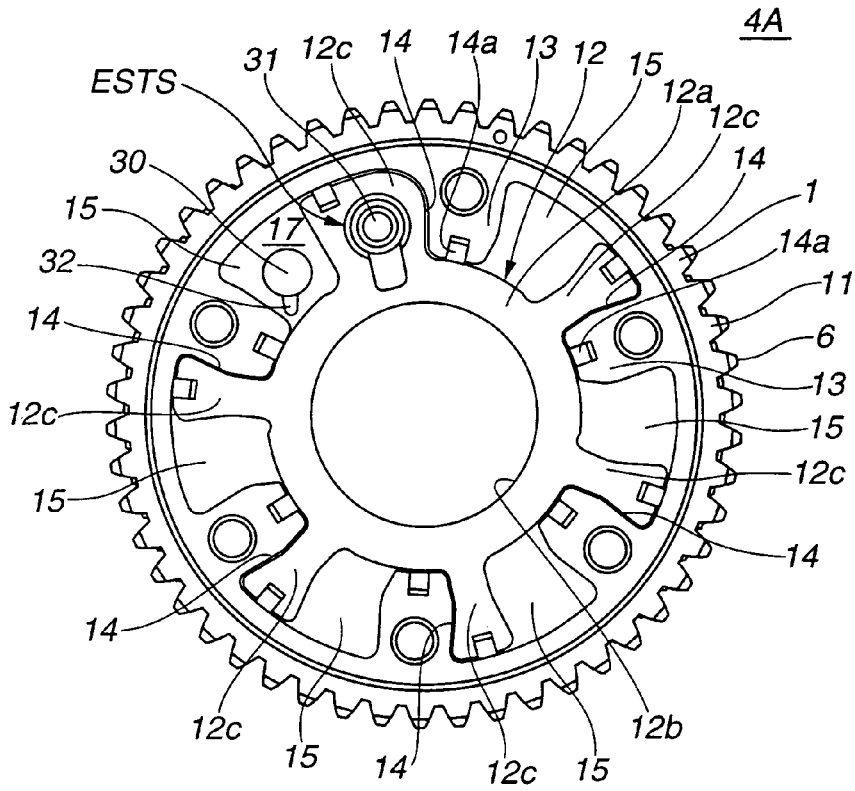
FIG. 9 is view also similar to FIG. 7, but showing a condition wherein the valve timing is set in an advanced side.

Under operation, the valve timing control device is forced to change its condition as shown in FIGS. 7, 8 and 9. These drawings show a retarded valve timing, an intermediate valve timing and an advanced valve timing respectively.

As is best seen from FIG. 9, the valve timing control device is provided with a so-called engine starting timing setter "ESTS" that can provide phase change mechanism 4A with a valve timing suitable for starting the engine.

As is seen from this drawing, engine starting timing setter "ESTS" comprises a circular recess 30 formed on an inner surface of first annular plate 17 of annular housing 11, a holding recess (not shown) formed on an inner surface of one enlarged vane 12*c* that is associated with circular recess 30, a lock pin 31 projectively held in the holding recess and a spring (not shown) compressed between lock pin 31 and a bottom of the holding recess to bias lock pin 31 toward first annular plate 17. Denoted by numeral 32 is an inlet recess connected to circular recess 30.

Thus, as is seen from FIG. 7, when vane member 12 takes the most counterclockwise position relative to annular housing 11 (viz., the most retarded position), lock pin 31 is projected into circular recess 30 to lock the position. With this, engine starting is suitably carried out. After starting the engine, the hydraulic fluid is led into circular recess 30 through inlet recess 32 thereby to move back lock in 31 against the spring canceling the locked condition of vane member 12 relative to annular housing 11.

In the following, operation of variable valve system of the first embodiment will be describe with the aid of the accompanying drawings.

For ease of understanding, the description will be commenced with respect to an engine starting.

In this case, the valve timing control device assumes the most retarded position as shown in FIG. 7 wherein lock pin 31 is engaged with circular recess 30 to lock the position. Under this condition, the engine staring is suitably carried out as has been mentioned hereinabove.

After engine starting, the control unit causes electromagnetic switch valve 26 to turn ON. Upon this, the spool of the valve 26 is moved against a spring "SP" to a given position where as is seen from FIG. 1 an outlet of oil pump 25 is connected with advancing fluid passage 24 and drain passage 27 is connected with retarding fluid passage 23.

Thus, under this condition, the hydraulic fluid from oil pump 25 is led into advancing work chambers 15 through advancing fluid passage 24 and at the same time, the hydraulic fluid in retarding work chambers 14 is led back to oil pan 28 through retarding fluid passage 23 and drain passage 27 thereby reducing the hydraulic pressure in the chambers 14. Upon this, lock pin 31 is disengaged from circular recess 30 by the work of the hydraulic pressure that is led to the recess 30 through inlet recess 32, and thus, the locked connection of vane member 12 to annular housing 11 becomes cancelled.

Thus, as is seen from FIG. 8, with increase of the hydraulic fluid fed to advancing work chambers 15, vane member 12 and thus intake camshaft 2 are turned clockwise in the drawing relative to annular housing 11. When, due to control by the control unit, feeding of hydraulic fluid to advancing work chambers 15 stops, vane member 12 and thus intake camshaft 2 keeps their intermediate position relative to annular housing 11, as is shown in FIG. 8. Under this condition, the valve timing control device provides the intake valves of the engine with an intermediate valve timing and thus, the engine can exhibit improved combustion efficiency at this operation range and thus improvement in output power and fuel consumption is achieved.

When the engine is subjected to a higher load, the control unit feeds electromagnetic switch valve 26 with the higher current. With this, the spool of the valve 26 is moved to the rightmost position against the spring "SP". Under this condition, as will be understood from FIG. 1, all of the hydraulic fluid in retarding work chambers 14 is led back to the oil pan 28 through retarding fluid passage 23 and at the same time the pressurized hydraulic fluid from oil pump 25 is fully fed to advancing work chambers 15 through advancing fluid passage 24.

Thus, as is seen from FIG. 9, vane member 12 and thus intake camshaft 2 are further turned in clockwise direction to their most clockwise position relative to annular housing 11 (viz., the most advanced position). Under this condition, the valve timing control device provides the intake valves of the engine with a most advanced valve timing.

When the engine is subjected to an idling, the control unit shuts off the electric feeding to electromagnetic switch valve 26. With this, as is seen from FIG. 1, the spool of the valve 26 is moved leftward due to the biasing force of the spring "SP" changing the fluid flow direction. That is, under this condition, the fluid from oil pump 25 is fed to retarding work chambers 14 through retarding fluid passage 23 and at the same time, the fluid in advancing work chambers 15 is fed back to the oil pan 28 through advancing fluid passage 24 and drain passage 27. With this, vane member 12 takes the above-mentioned most counterclockwise position of FIG. 7 causing the intake valves of the engine to take the most retarded valve timing. Under this condition, stable operation of the engine and improved fuel consumption are obtained.

In the following, a method of mounting essential parts of phase change mechanism 4A to intake camshaft 2 will be described with the aid of FIG. 2.

First, as is illustrated by phantom line of FIG. 2, a unit 29 that includes annular housing 11 that has vane member 12 loosely received therein is previously produced. That is, for production of this unit 29, as described hereinabove and as is seen from FIGS. 1, 3 and 5, housing body 16 and first and second annular plates 17 and 18 are united by means of six bolts 19 to constitute annular housing 11, and then as is seen from FIG. 7, vane member 12 is properly set in annular housing 11.

Then, as is seen from FIG. 2, unit 29 is axially put onto intake camshaft 2 from a left end of the camshaft 2 allowing circular openings 12*b*, 17*c* and 18*b* thereof to receive therein a part of the camshaft 2, and unit 29 is moved rightward. At a part where first cam lobe 7*a* is arranged, unit 29 is radially shifted upward in the illustrated case, that is, in a direction in which the highest part of cam lobe 7*a* projects to permit the circular openings 12*b*, 17*c* and 18*b* to clear first cam lobe 7*a*. After clearing first cam lobe 7*a*, unit 29 is further moved rightward to a part where second cam lobe 7*b* is arranged. At this part, unit 29 is radially shifted downward in the illustrated case, that is, in a direction in which the highest part of cam lobe 7*b* projects to permit the circular openings 12*b*, 17*b* and 18*b* to clear second cam lobe 7*b*.

Thereafter, unit 29 is slid onto enlarged cylindrical portion 8 of intake camshaft 2 and set at a proper given position on the portion 8. That is, under this condition, circular opening 17*b* is on the peripheral surface of flange portion 8*a* and circular opening 12*b* is on the major part of enlarged cylindrical portion 8.

Then, as is understood from the drawing, nut 20 is brought into engagement with externally threaded portion 8*b* of intake camshaft 2 after passing through the left half of the camshaft 2. Then, by turning nut 20 in a fastening direction by a spanner or the like.

With the above-mentioned steps, unit 29 including annular housing 11 having vane member 12 installed therein is properly mounted on enlarged cylindrical portion 8 of intake camshaft 2, as shown. That is, assemblage of phase change mechanism 4A that includes annular housing 11 and vane member 12 is established.

It is now to be noted that under this assembled condition, vane member 12 is secured to enlarged cylindrical portion 8 of intake camshaft 2 and thus these parts 12 and 2 move like a single unit, and annular housing 11 is permitted to rotate but slightly about vane member 12 by an angle that corresponds the above-mentioned angular range between the most retarded position of vane member 12 and the most advanced position of the same.

In the following, advantages of variable valve system of the first embodiment will be described.

First, as has been just mentioned hereinabove, phase change mechanism 4A can be readily mounted to intake camshaft 2. The mechanism 4A is mounted on a middle portion of the camshaft 2, and thus, the entire length of a unit that includes the camshaft 2 and the mechanism 4A does not exceed the length of the camshaft 2. That is, the unit has a compact size and thus an engine to which the unit is practically mounted can have a compact, which makes a layout of the engine in an engine room of a vehicle easy.

As is seen from FIGS. 5 and 6, sprocket 1 is formed on an axially middle portion of a peripheral cylindrical surface of annular housing 11. The entire construction of phase change mechanism 4A can have a sufficiently reduced axial length.

Vane member 12 is detachably connected to intake camshaft 2 by means of nut 20. Thus, easy changing of vane member 12 is achieved.

As is seen from FIG. 1, cylindrical base portion 20*b* of nut 20 is constructed and arranged to enter circular opening 18*b* of second annular plate 18 of annular housing 11. Such construction and arrangement promote reduction in the axial length of phase change mechanism 4A.

Because of provision of engine starting timing setter "ESTS" (see FIG. 9) that includes circular recess 30 provided by annular housing 11 and the projective lock pin 31 provided by vane member 12, phase change mechanism 4A can assuredly provide the intake valves of the engine with a valve timing suitable for starting the engine. Because circular recess 30 is formed in first annular plate 17 of annular housing 11, there is not need of providing a separate part for such recess 30, and thus, the setter "ESTS" can be simple in construction.

As is seen from FIG. 5, the torque of intake camshaft 2 is transmitted to exhaust camshaft 3 through second gear 17*b* formed on first annular plate 17 and transmission gear 10 secured to exhaust camshaft 3. Because these gears 17*b* and 10 are mounted on middle portions of respective camshafts 2 and 3, provision of these gears 17*b* and 10 has no influence on change in length of camshafts 2 and 3.

As is seen from FIG. 1, respective ends 23*a* and 24*a* of retarding and advancing fluid passages 23 and 24 are exposed to cylindrical bores 2*d* and 2*c* that are provided in intake camshaft 2 at diametrically opposite positions with respect to enlarged cylindrical portion 8. The arrangement of the bores 2*d* and 2*c* provides intake camshaft 2 with a balanced passage construction and thus mechanical strength of the camshaft 2 is not sacrificed.

Figure 10:
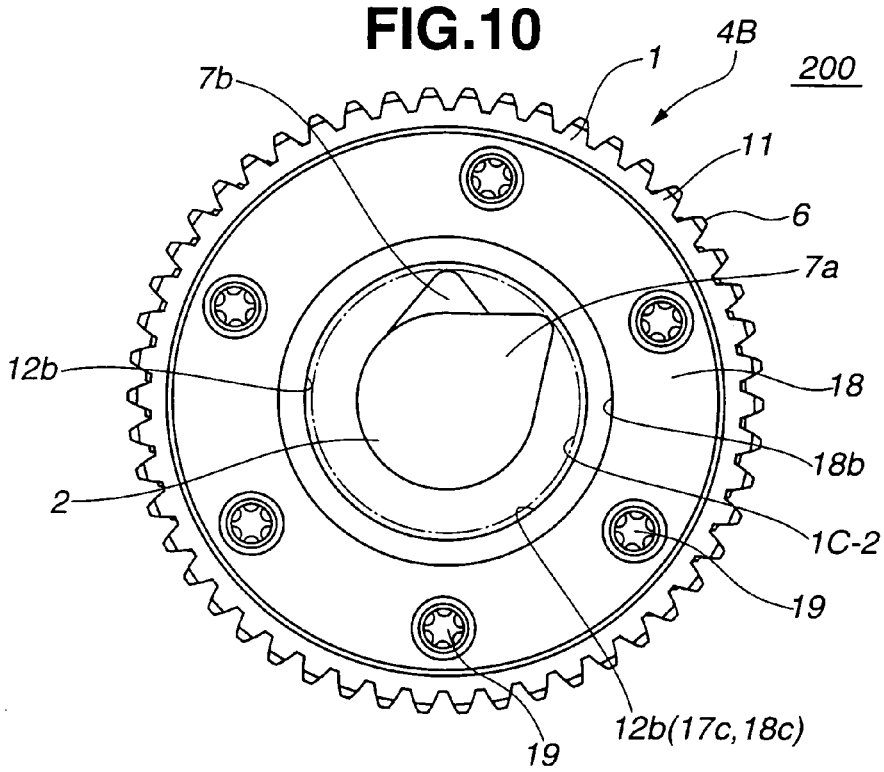
FIG. 10 is a view similar to FIG. 3, but showing a valve timing control mechanism employed in a variable valve system of a second embodiment of the present invention.

Referring to FIG. 10, there is shown a view similar to FIG. 3, but showing a phase change mechanism 4B employed in a valve timing control mechanism 200 for a variable valve system of a second embodiment of the present invention.

As will be understood when comparing FIG. 10 with FIG. 3, in this phase change mechanism 4B, the diameters of circular openings 12*b*, 17*c* and 18*b* of vane member 12 and first and second annular plates 17 and 18 are larger than a diameter of an imaginary circle "IC-2" that is drawn by a radially outermost part of each cam lobe 7*a*, 7*b*, 7*c* or 7*d* when intake camshaft 2 rotates about its axis.

Thus, in this second embodiment, unit 29 (see FIG. 2) can be easily brought to enlarged cylindrical portion 8 of intake camshaft 2 without making a zig-zag movement along the shaft 2 like in case of the above-mentioned first embodiment.

Figure 11:
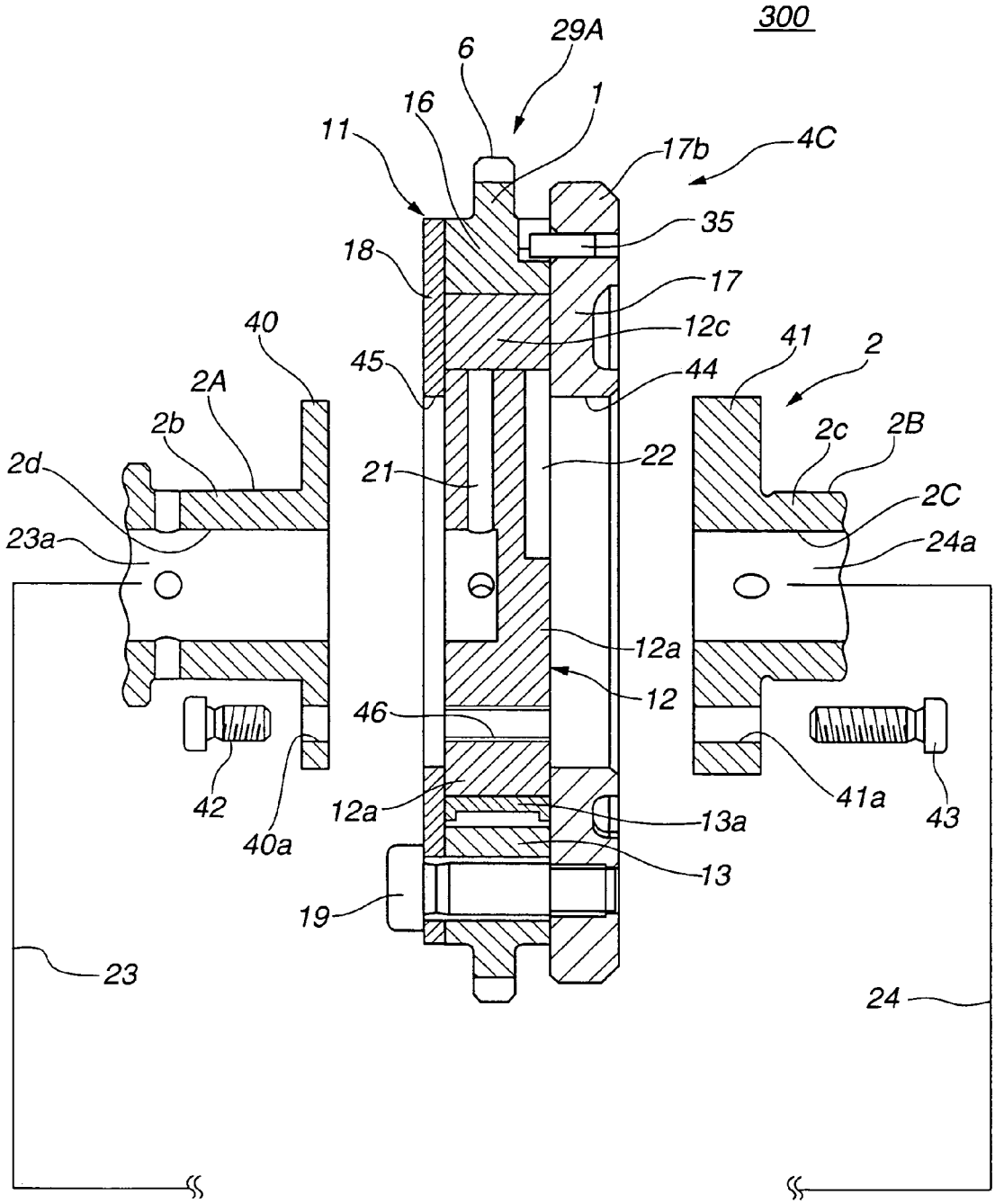
FIG. 11 is an exploded and sectional view of a valve timing control mechanism employed in a variable valve system of a third embodiment of the present invention.
Figure 12:
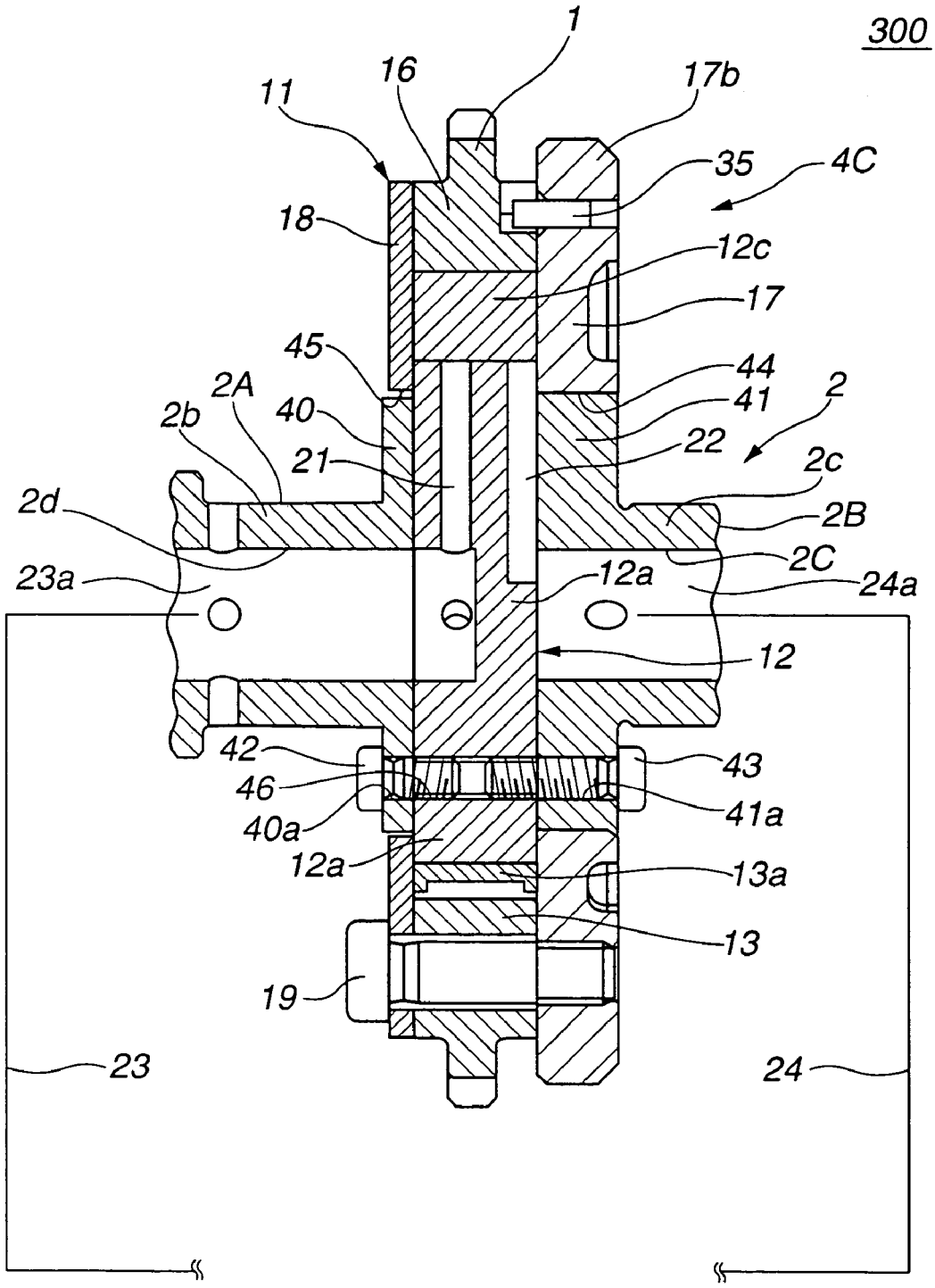
FIG. 12 is a sectional view of the valve timing control mechanism of FIG. 11 in an assembled condition.

Referring to FIGS. 11 and 12, there is shown a phase change mechanism 4C employed in a valve timing control mechanism 300 for a variable valve system of a third embodiment of the present invention.

Since the mechanism 4C is similar to the above-mentioned mechanism 4A employed in the first embodiment, only parts or portions that are different from those of the mechanism 4A will be described in detail in the following.

As shown in FIGS. 11 and 12, in this mechanism 4C, intake camshaft 2 is divided into two cylindrical pieces 2A and 2B, and vane member 12 is tightly sandwiched between mutually facing ends of the two cylindrical pieces 2A and 2B, as will be seen from FIG. 12.

As shown in FIG. 11, the two cylindrical pieces 2A and 2B have at the mutually facing ends thereof respective circular flanges 40 and 41 of which diameters are substantially same. Flanges 40 and 41 are respectively formed with six bolt holes 40*a* and 41*a* through which shorter and longer bolts 42 and 43 are to pass, as will be described in the following.

The thickness of flange 40 is substantially the same as that of second annular plate 18, and the thickness of the other flange 41 is substantially the same as that of first annular plate 17 which is thick.

A circular opening of first annular plate 17 is denoted by numeral 44 and a circular opening of second annular plate 18 is denoted by numeral 45.

As is seen from FIG. 12, upon assembly, flange 41 is received in circular opening 44 of first annular plate 17, and the other flange 40 is received in circular opening 45 of second annular plate 18. Annular housing 11 that includes housing body 16 and first and second annular plates 17 and 18 is rotatably but slightly supported by the thicker flange 41 of cylindrical piece 2B.

As is seen from the drawings, vane member 12 is circular in shape and has at its vane rotor center portion 12*a* six radial passages 21 that connect cylindrical bore 2*d* to six retarding work chambers 14, and six radial passages 22 that connect the other cylindrical bore 2*c* to six advancing work chambers 15.

Vane rotor center portion 12*a* has further six threaded bolt holes 46 that are, when properly positioned, aligned with the above-mentioned bolt holes 40*a* of flange 40 and bolt holes 41*a* of the other flange 41.

As is seen from FIG. 12, upon assembly, connection of flange 40 to vane member 12 is achieved by shorter bolts 42 engaged with left portions of threaded bolt holes 46, and connection of flange 41 to vane member 12 is achieved by longer bolts 43 engaged with right portions of the bolt holes 46.

In the following, a method of assembling valve timing control mechanism 300, that is, of mounting phase change mechanism 4C on the two cylindrical pieces 2A and 2B will be described with the aid of FIGS. 11 and 12.

First, as is seen from FIG. 11, a unit 29A that includes annular housing 11 that has vane member 12 installed therein is previously produced. For production of this unit 29A, first and second annular plates 17 and 18 are secured to housing body 16 by means of six bolts 19 having vane member 12 received therein.

Then, as is seen from FIG. 12, after completing positioning therebetween, flange 40 of one cylindrical piece 2A and flange 41 of the other cylindrical piece 2B are secured to axially opposed surfaces of vane rotor center portion 12*a* of vane member 12 by means of six shorter bolts 42 and six longer bolts 43.

As is seen from FIG. 12, when the two pieces 2A and 2B are properly connected to vane member 12, flange 40 is received in circular opening 45 of second annular plate 18 leaving a slight annular clearance therebetween, and the other flange 41 is intimately but rotatably received in circular opening 44 of first annular plate 17.

Because of the two piece construction of intake camshaft 2, assemblage of phase change mechanism 4C is easily carried out as has been described hereinabove.

Also in this phase change mechanism 4C, vane member 12 is mounted on a middle portion of an assembled intake camshaft 2, and thus, the entire length of the unit that includes the camshaft 2 and the mechanism 4C does not exceed the length of the camshaft 2.

Figure 13:
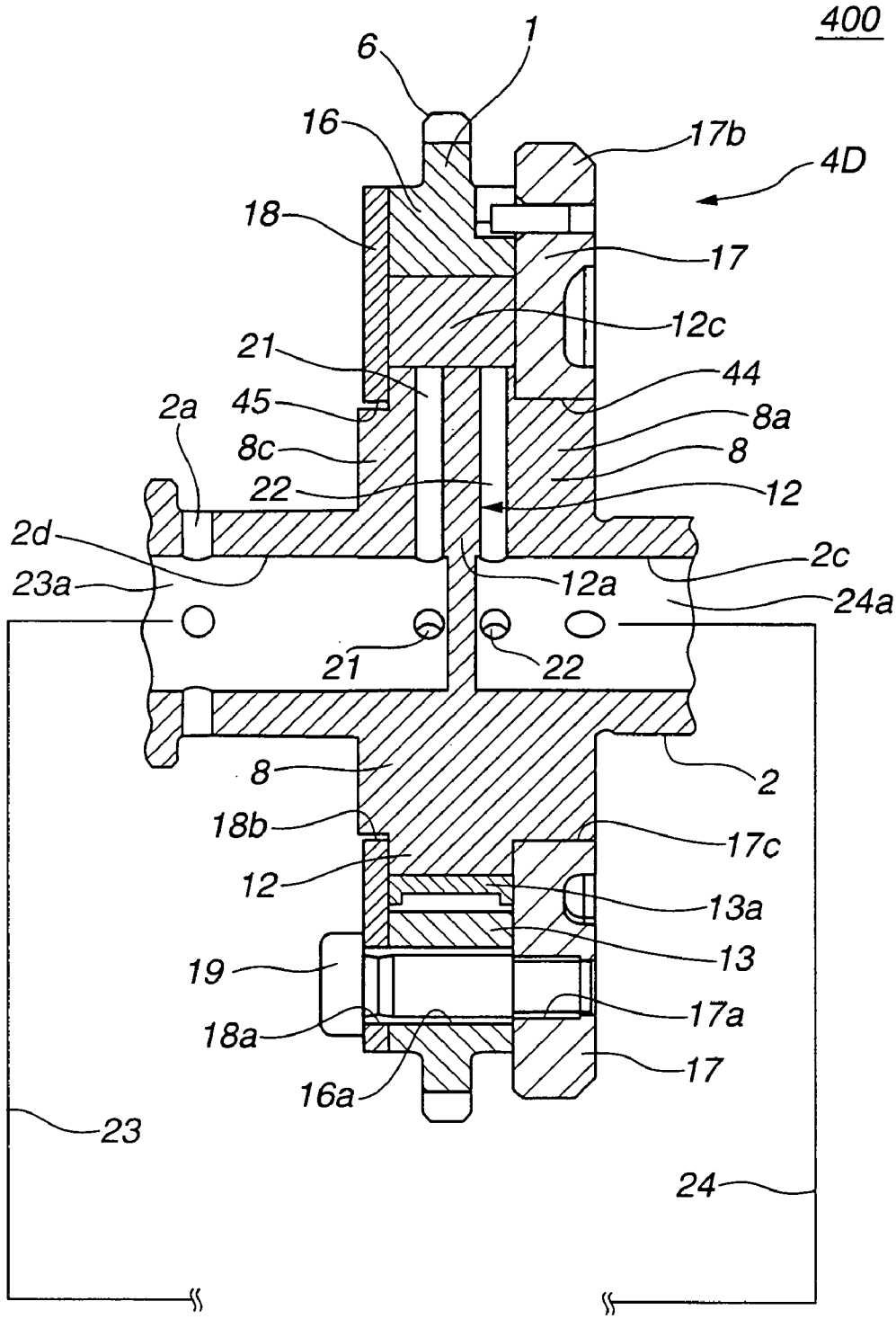
FIG. 13 is a view similar to FIG. 12, but showing a valve timing control mechanism employed in a variable valve system of a fourth embodiment of the present invention.

Referring to FIG. 13, there is shown a phase change mechanism 4D employed in a valve timing control mechanism 400 for a variable valve system of a fourth embodiment of the present invention.

Since the mechanism 4D is similar to the above-mentioned mechanism 4A employed in the first embodiment, only parts or portions that are different from those of the mechanism 4A will be described in detail in the following.

As shown in the drawing, in this mechanism 4D, vane member 12 is integral with intake camshaft 2. That is, vane member 12 is integrally formed on enlarged cylindrical portion 8 of the camshaft 2. Denoted by numeral 8*c* is a cylindrical left part of the portion 8, that is provided as a substitute for nut 20 used in the phase change mechanism 4A of the first embodiment of FIG. 1.

More specifically, vane rotor center portion 12 with six vanes 12*c* is integral with the generally middle portion of the camshaft 2, and vane rotor center portion 12 has six radial passages 21 that connect cylindrical bore 2*d* to six retarding work chambers 14, and six radial passages 22 that connect the other cylindrical bore 2*c* to six advancing work chambers 15.

In the following, a method of assembling valve timing control mechanism 400, that is, of mounting phase change mechanism 4D on intake camshaft 2 will be described with the aid of FIG. 13.

First, annular housing body 16 is received on intake camshaft 2 from one end of the same and moved toward and set on vane rotor center portion 12. Then, after being put on and moved along the camshaft 2, first and second annular plates 17 and 18 are positioned relative to enlarged cylindrical portion 8 of the camshaft 2. Then, these two annular plates 17 and 18 are secured to axially opposed surfaces of the housing body 16 by means of six bolts 19.

Due to the integral structure of vane member 12 with intake shaft 2, the number of parts used for assembling phase change mechanism 4D can be reduced and assembly of the mechanism 4D is easily carried out.

The entire contents of Japanese Patent Application 2004-180426 filed Jun. 18, 2004 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A variable valve system of an internal combustion engine, comprising:

a camshaft;

a plurality of cam lobes integral with and mounted on the camshaft and operating to open and close engine valves when the camshaft rotates, every adjacent two cam lobes being apart from one another by predetermined distances respectively;

an annular vane member having a plurality of vanes that project radially outward therefrom and a circular opening that is sized to permit the cam lobes to pass therethrough;

an annular housing housing therein the vane member in a manner to permit a rotation of the vane member relative to the annular housing, the annular housing having a circular opening that is sized to permit the cam lobes to pass therethrough;

a drive power transmission mechanism that transmits a torque of a crankshaft of the engine to the annular housing;

at least one pair of retarding and advancing work chambers defined between the annular vane member and the annular housing; and a hydraulic circuit that selectively feeds a hydraulic fluid to one of the retarding and advancing work chambers in accordance with an operation condition of the engine, wherein each of an axial length of the annular housing and an axial length of the vane member is set smaller than the shortest one of the predetermined distances, and wherein the vane member is tightly mounted on a given portion of the camshaft to rotate therewith.

2. A variable valve system as claimed in claim 1, in which the annular vane member is secured to the given portion of the camshaft by means of a nut.

3. A variable valve system as claimed in claim 2, in which the given portion of the camshaft comprises:

an enlarged cylindrical portion integrally formed no the camshaft and intimately received in the circular opening of the vane member;

a flange portion integrally formed on the camshaft at an axial one end of the enlarged cylindrical portion and intimately contacting one axial end surface of the vane member, an outer diameter of the flange portion being larger than that of the circular opening of the annular vane member; and an externally threaded portion integrally formed on the camshaft at the other axial end of the enlarged cylindrical portion, wherein the nut is engaged with the externally threaded portion to press the vane member against the flange portion thereby to secure the vane member to the flange portion.

4. A variable valve system as claimed in claim 3, in which a cylindrical base portion is partially inserted into the annular housing to abut against the vane member.

5. A variable valve system as claimed in claim 3, in which the annular vane member is formed with a non-circular head portion that is to be handled by a turning tool.

6. A variable valve system as claimed in claim 5, in which the annular housing comprises a plurality of parts that are united by means of bolts, in which the nut is positioned radially inside with respect to the bolts, and in which heads of the bolts are flush with the head of the nut.

7. A variable valve system as claimed in claim 1, in which the annular housing comprises:

an annular housing body having a first gear formed therearound;

a first annular plate secured to one axial end of the annular housing body, the first annular plate having a second gear formed therearound; and a second annular plate secured to the other axial end of the annular housing body, wherein one of the first and second gears constitutes part of the drive power transmission mechanism through which the torque of the crankshaft of the engine is transmitted to the annular housing, and wherein the other one of the first and second gears is used for transmitting the torque of the annular housing to another camshaft of the engine through a transmission gear mounted on the camshaft.

8. A variable valve system as claimed in claim 7, further comprising a timing setter that is able to provide a fixed angular position of the vane member relative to the annular housing, the timing setter comprising:

a recess formed in the first annular plate;

a lock pin projectively held by the vane member;

a biasing member for biasing the lock pin in a direction to put the lock pin into the recess thereby to achieve a locked engagement therebetween; and an inlet recess through which a hydraulic fluid is fed into the recess for canceling the locked engagement.

9. A variable valve system as claimed in claim 1, in which the camshaft is formed at the given portion thereof with both a retarding fluid passage that is connected to the retarding work chamber and an advancing fluid passage that is connected to the advancing work chamber.

10. A variable valve system of an internal combustion engine, comprising:

two cylindrical pieces that constitute a camshaft when coaxially connected;

a plurality of cam lobes integral with and mounted on the two cylindrical pieces and operating to open and close engine valves when the cylindrical pieces rotate about their common axis;

a circular vane member having a plurality vanes that project radially outward therefrom, the vane member being tightly put between mutually facing ends of the cylindrical pieces to rotate together with the camshaft;

an annular housing housing therein the vane member in a manner to permit a rotation of the vane member relative to the annular housing, the annular housing having a circular opening that is sized to permit the mutually facing ends of the cylindrical pieces to pass therethrough;

a plurality of connecting bolts through which the two cylindrical pieces and the circular vane member are united to constitute a single construction;

a drive power transmission mechanism that transmits a torque of a crankshaft of the engine to the annular housing;

at least one pair of retarding and advancing work chambers defined between the circular vane member and the annular housing; and a circular circuit that selectively feeds a hydraulic fluid to one of the retarding and advancing work chambers in accordance with an operation condition of the engine.

11. A variable valve system as claimed in claim 10, in which the annular housing comprises:

an annular housing body having a first gear formed therearound;

a first annular plate secured to one axial end of the annular housing body, the first annular plate having a second gear formed therearound; and a second annular plate secured to the other axial end of the annular housing body, wherein one of the first and second gears constitutes part of the drive power transmission mechanism through which the torque of a crankshaft of the engine is transmitted to the annular housing, and wherein the other one of the first and second gears is used for transmitting the torque of the annular housing to another camshaft of the engine through a transmission gear mounted on the camshaft.

12. A variable valve system as claimed in claim 11, further comprising a timing setter that is able to provide a fixed angular position of the vane member relative to the annular housing, the timing setter comprising:

a recess formed in the first annular plate;

a lock pin projectively held by the vane member;

a biasing member for biasing the lock pin in a direction to put the lock pin into the recess thereby to achieve a locked engagement therebetween; and an inlet recess through which a hydraulic fluid is fed into the recess for canceling the locked engagement.

13. A variable valve system as claimed in claim 10, in which one of the cylindrical pieces is formed with a retarding fluid passage that is connected to the retarding work chamber and the other one of the cylindrical pieces is formed with an advancing fluid passage that is connected to the advancing work chamber.

14. A variable valve system of an internal combustion engine, comprising:

a camshaft;

a plurality of cam lobes integral with and mounted on the camshaft and operating to open and close engine valves when the camshaft rotates, every adjacent two cam lobes being apart from one another by predetermined distances respectively;

a circular vane member integral with the camshaft and having a plurality of vanes that project radially outward therefrom;

an annular housing housing therein the vane member in a manner to permit a rotation of the vane member relative to the annular housing, the annular housing having a circular opening that is sized to permit the cam lobes and the vane member to pass therethrough;

a drive power transmitting mechanism that transmits a torque of a crankshaft of the engine to the annular housing;

at least one pair of retarding and advancing work chambers defined between the vane member and the annular housing; and a hydraulic circuit that selectively feeds a hydraulic fluid to one of the retarding and advancing work chambers in accordance with an operation condition of the engine, wherein an axial length of the annular housing is set smaller than the shortest one of the predetermined distances.

15. A variable valve system as claimed in claim 14, in which the annular housing comprises:

an annular housing body having a first gear formed therearound;

a first annular plate secured to one axial end of the annular housing body, the first annular plate having a second gear formed therearound; and a second annular plate secured to the other axial end of the annular housing body, wherein one of the first and second gears constitutes part of the drive power transmission mechanism through which the torque of a crankshaft of the engine is transmitted to the annular housing, and wherein the other one of the first and second gears is used for transmitting the torque of the annular housing to another camshaft of the engine through a transmission gear mounted on the camshaft.

16. A variable valve system as claimed in claim 15, further comprising a timing setter that is able to provide a fixed angular position of the vane member relative to the annular housing, the timing setter comprising:

a recess formed in the first annular plate;

a lock pin projectively held by the vane member;

a biasing member for biasing the lock pin in a direction to put the lock pin into the recess thereby to achieve a locked engagement therebetween; and an inlet recess through which a hydraulic fluid is fed into the recess for canceling the locked engagement.

17. A variable valve system as claimed in claim 14, in which the camshaft is formed with both a retarding fluid passage that is connected to the retarding work chamber and an advancing fluid passage that is connected to the advancing work chamber.

18. A variable valve system of an internal combustion engine, comprising:

a camshaft;

a plurality of cam lobes integral with and mounted on the camshaft and operating to open and close engine valves when the camshaft rotates, every adjacent two cam lobes being apart from one another by predetermined distances respectively;

an annular vane member having a plurality of vanes that project radially outward therefrom and a circular opening that is sized to permit the cam lobes to pass therethrough;

an annular housing housing therein the vane member in a manner to permit a rotation of the vane member relative to the annular housing, the annular housing having a circular opening that is sized to permit the cam lobes to pass therethrough;

a drive power transmission mechanism that transmits a torque of a crankshaft of the engine to the annular housing;

at least one pair of retarding and advancing work chambers defined between the annular vane member and the annular housing; and a hydraulic circuit that selectively feeds a hydraulic fluid to one of the retarding and advancing work chambers in accordance with an operation condition of the engine, wherein each of the circular opening of the annular vane member and the circular opening of the annular housing is larger in diameter than an imaginary circle that has a diameter extending between highest and lowest parts of each cam lobe and larger in diameter than an imaginary circle that is drawn by a radially outermost part of each cam lobe when the camshaft rotates, and wherein the vane member is tightly mounted on a given portion of the camshaft to rotate therewith.

19. A variable valve system as claimed in claim 18, in which the annular vane member is secured to the given portion of the camshaft by means of a nut.

20. A variable valve system as claimed in claim 19, in which the given portion of the camshaft comprises:

an enlarged cylindrical portion integrally formed no the camshaft and intimately received in the circular opening of the vane member;

a flange portion integrally formed on the camshaft at an axial one end of the enlarged cylindrical portion and intimately contacting one axial end surface of the vane member, an outer diameter of the flange portion being larger than that of the circular opening of the annular vane member; and an externally threaded portion integrally formed on the camshaft at the other axial end of the enlarged cylindrical portion, wherein the nut is engaged with the externally threaded portion to press the vane member against the flange portion thereby to secure the vane member to the flange portion.

21. A variable valve system as claimed in claim 19, in which the nut is formed with a non-circular head portion that is to be handled by a turning tool.

22. A variable valve system as claimed in claim 21, in which the annular housing comprises a plurality of parts that are united by means of bolts, in which the nut is positioned radially inside with respect to the bolts, and in which heads of the bolts are flush with the head of the nut.

23. A variable valve system as claimed in claim 18, in which the annular housing comprises:

an annular housing body having a first gear formed therearound;

a first annular plate secured to one axial end of the annular housing body, the first annular plate having a second gear formed therearound; and a second annular plate secured to the other axial end of the annular housing body, wherein one of the first and second gears constitutes part of the drive power transmission mechanism through which the torque of the crankshaft of the engine is transmitted to the annular housing, and wherein the other one of the first and second gears is used for transmitting the torque of the annular housing to another camshaft of the engine through a transmission gear mounted on the camshaft.

24. A variable valve system as claimed in claim 23, further comprising a timing setter that is able to provide a fixed angular position of the vane member relative to the annular housing, the timing setter comprising:

a recess formed in the first annular plate;

a lock pin projectively held by the vane member;

a biasing member for biasing the lock pin in a direction to put the lock pin into the recess thereby to achieve a locked engagement therebetween; and an inlet recess through which a hydraulic fluid is fed into the recess for canceling the locked engagement.

25. A variable valve system as claimed in claim 18, in which the camshaft is formed at the given portion thereof with both a retarding fluid passage that is connected to the retarding work chamber and an advancing fluid passage that is connected to the advancing work chamber.

26. A method of assembling a variable valve system of an internal combustion engine, the variable valve system comprising a camshaft; a plurality of cam lobes integral with and mounted on the camshaft and operating to open and close engine valves when the camshaft rotates, every adjacent two cam lobes being apart from one another by predetermined distances respectively; an annular vane member having a plurality of vanes that project radially outward therefrom and a circular opening that is sized to permit the cam lobes to pass therethrough; an annular housing housing therein the vane member in a manner to permit a rotation of the vane member relative to the annular housing, the annular housing having a circular opening that is sized to permit the cam lobes to pass therethrough; a drive power transmission mechanism that transmits a torque of a crankshaft of the engine to the annular housing; at least one pair of retarding and advancing work chambers defined between the annular vane member and the annular housing; and a hydraulic circuit that selectively feeds a hydraulic fluid to one of the retarding and advancing work chambers in accordance with an operation condition of the engine, each of an axial length of the annular housing and an axial length of the vane member being smaller than the shortest one of the predetermined distances, the method comprising the steps of:

producing a unit including the annular housing that has the vane member loosely received therein;

setting the vane member at a right position in the annular housing;

putting the unit onto the camshaft from one end of the camshaft allowing the circular openings thereof to receive therein the camshaft;

moving the unit to an enlarged given portion of the camshaft by carrying out a zig-zag movement of the unit to clear the cam lobes;

positioning the unit relative to the enlarged given portion; and engaging a nut with a threaded part of the enlarged given portion to press the vane member against a flange portion of the enlarged given portion thereby to secure the vane member to the enlarged given portion.

* * * * *